United States Patent [19]

McNeill et al.

[11] 4,178,534

[45] Dec. 11, 1979

[54] METHODS OF AND APPARATUS FOR ELECTRODELESS DISCHARGE EXCITATION

[75] Inventors: William H. McNeill, Carlisle; Joseph M. Lech, Westford; Paul O. Haugsjaa, Acton; Robert J. Regan, Needham, all of Mass.

[73] Assignee: GTE Laboratories Incorporated, Waltham, Mass.

[21] Appl. No.: 922,625

[22] Filed: Jul. 7, 1978

[51] Int. Cl.[2] ..... H01J 7/46

[52] U.S. Cl. ..... 315/39; 313/229; 315/248

[58] Field of Search ..... 315/39, 248, 267, 344

[56] References Cited

U.S. PATENT DOCUMENTS

| | | | |
|---|---|---|---|
| 3,942,058 | 3/1976 | Haugsjaa et al. | 315/39 X |
| 3,942,068 | 3/1976 | Haugsjaa et al. | 315/39 |
| 3,943,404 | 3/1976 | McNeill et al. | 315/39 |

*Primary Examiner*—Alfred E. Smith
*Assistant Examiner*—Charles F. Roberts
*Attorney, Agent, or Firm*—Fred Fisher

[57] ABSTRACT

A light source includes an electrodeless lamp having a generally cylindrically shaped envelope made of a light transmitting substance. A volatile fill material, enclosed within the envelope, emits light upon breakdown and excitation. A termination fixture has an outer conductor disposed around its inner conductor, both conductors having a first end which couples power to the lamp and a second end coupled to an alternating current power source. A first end of conductive means is coupled to the first end of the inner conductor, a second end of the conductive means being open-circuited. The conductive means has an electrical length whereby axial electric field maxima and minima occur thereon. The envelope is oriented centrally and axially within the conductive means so that an axial, non-toroidal arc occurs within the envelope, but does not attach to its interior walls, thereby enhancing the life of the lamp. The conductive means can be formed in a helical or spiral configuration. The spiral configuration can take various forms, such as constant or continuously varying. A small spherical conductor can be affixed to the second end of a helical conductive means to inhibit electrical breakdown from an otherwise sharp end.

A power source operates at a frequency having a wavelength $\lambda_o$. The discharge is contained in an envelope (having an internal length substantially n halves of an axial wavelength $\lambda_z$) centrally located within the spiral conductive means. Axial electric field minima occur distances $2n\lambda_z/4$ from the open circuited end of the conductive means (i.e., at the ends of the envelope) and an axial non-toroidal arc occurs within the envelope but does not attach to its interior wall. If the outer conductor circumferentially surrounds the spiral conductive means and the envelope therewithin to form a cylinder having a radius b, and the spiral conductive means includes a coil having a radius a and a constant pitch p then $$\frac{\lambda_z}{\lambda_o} = \left[1 + \frac{2\pi^2 a^2}{p^2} \cdot \frac{1 - (a/b)^2}{\log b/a}\right]^{-\frac{1}{2}}$$

With certain designs, a plurality of arcs can occur within the envelope.

An electrodeless lamp having a generally cylindrically shaped envelope with an internal length $n\lambda/2$ (wherein n is a positive integer) can be excited by providing an electric field consisting of a voltage standing wave with points of axial electric field minima separated from each other by a distance $\lambda/2$, and orienting the lamp with respect to the field so that the opposed ends of the lamp are aligned with different points of the axial electric field minima, so that an axial, non-toroidal arc occurs within the envelope but does not attach to its interior wall.

25 Claims, 11 Drawing Figures

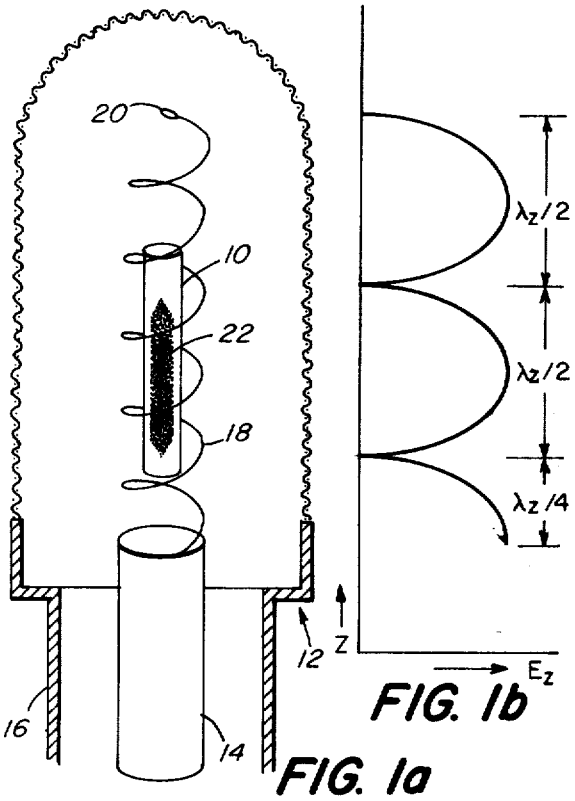
FIG. 1b
FIG. 1a
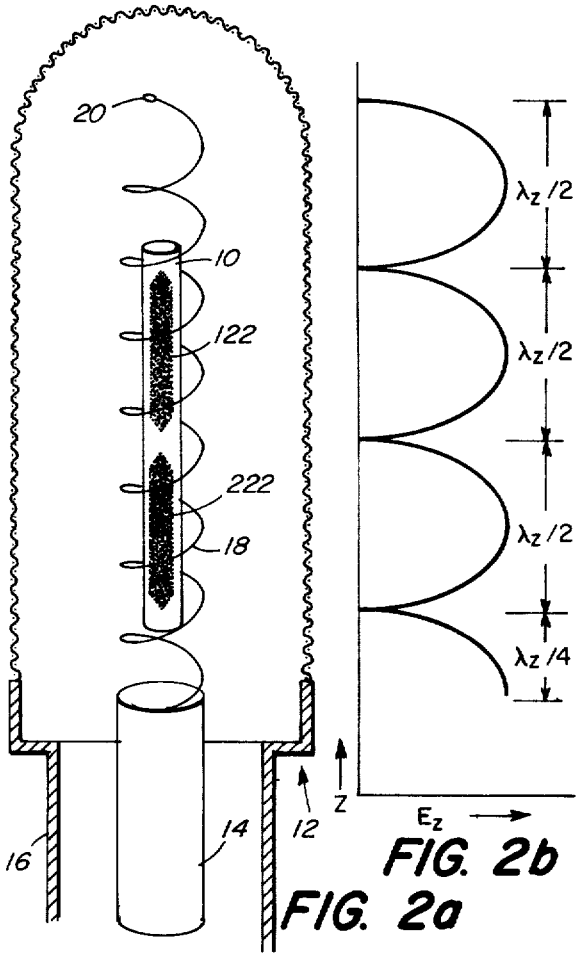
FIG. 2b
FIG. 2a
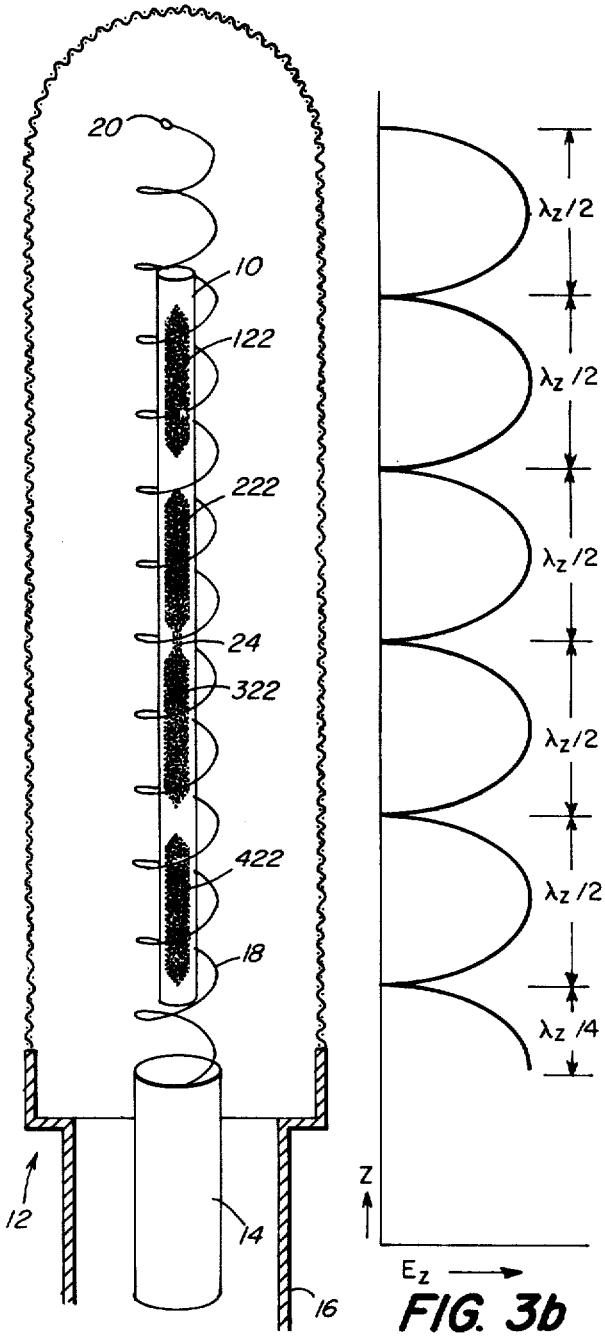
FIG. 3b
FIG. 3a

METHODS OF AND APPARATUS FOR ELECTRODELESS DISCHARGE EXCITATION

BACKGROUND OF THE INVENTION

1. Field of the Invention

This invention relates to methods of and apparatus for electrodeless discharge excitation. Accordingly, it is a general object of this invention to provide new and improved methods and apparatus of such character.

2. Description of the Prior Art

The following U.S. patents, assigned to the assignee of this application, relate to helical structures used with electrodeless lamps.

| Patent No. | Patentee | Issue Date |
|---|---|---|
| 3,942,058 | Haugsjaa et al. | March 2, 1976 |
| 3,942,068 | Haugsjaa et al. | March 2, 1976 |
| 3,943,404 | McNeill et al. | March 9, 1976 |

The patentees of U.S. Pat. Nos. 3,942,068 and 3,943,404 correspond to the applicants of this application.

U.S. Pat. No. 3,942,058

U.S. Pat. No. 3,942,058 to Haugsjaa et al., entitled "Electrodeless Light Source Having Improved Arc Shaping Capability", discusses the manner of operation of the electric fields at column 4, lines 26–44, with regard to region $I(R_I)$ where the lamp is inside the helix, as follows:

A helical line inside a conducting cylinder constitutes a slow wave structure; if $\Psi$ is the pitch angle, such that $\cot \Psi = 2\pi a/p$, where a is the helix radius and p is the pitch, then the wave propagation velocity is $v = c \sin \Psi$. Thus, the phase velocity is always less than the velocity of light. The wavelength along the helix is reduced, $\lambda_H = \lambda_o \sin \Psi$. Hence, a quarter-wave termination fixture can be reduced in length by the factor $\sin \Psi$.

Wave propagation on a helix, is, in general, complex. However, much of the observed behavior of arcs in helices can be understood in terms of the dominant mode. This mode has a field pattern with an electric field component $E_z$ in axial direction, and also a field $E\phi$ in the azimuthal direction. Thus, in FIG. 2 a lamp placed in the region $I(R_1)$ inside the helix might have either an axial arc or a toroidal (donut shaped) arc lying the horizontal plane. The ratio of the fields in (sic) controlled by the helix parameters; $E_z/E\phi = (a/r) \cot \Psi$.

The sentence following discusses the direction of excitation when the lamp is placed just above the helix:

A lamp placed just above the helix in region II ($R_{11}$) would be excited in the axial direction.

U.S. Pat. No. 3,942,068

U.S. Pat. No. 3,942,068 suggests the use of a helix to reduce the microwave field at the base of an electrodeless lamp, and thereby reduce the arc attachment to one end of the lamp envelope.

As set forth in the Abstract, the end of an inner conductor is shaped such as to inhibit the arc of the lamp from attaching to the lamp envelope. In one embodiment, the inner conductor end is shaped as a hollow helical coil which generates an axial and azimuthal electric field component to create a toroidal arc within the lamp.

As set forth in the Summary of the Invention, some objects of the invention were to provide an electrodeless light source in which the arc in an electrodeless lamp is not attached to the wall of the lamp envelope, and to provide a termination fixture for the lamp in which the inner conductor is shaped such as to control the electric field strength at the lamp envelope wall. The invention relates to a light source which includes a source of power at a high frequency, an electrodeless lamp having an envelope made of a light transmitting substance and a volatile fill material enclosed within the envelope, the fill material emitting light upon breakdown and excitation, a termination fixture having an inner conductor and an outer conductor disposed around the inner conductor, the conductors having one end which couples power to the lamp and another end which is coupled to the source and the inner conductor having means at the lamp coupling end for controlling the electric field strength in a region adjacent to the interior wall of the envelope to inhibit the formation of an arc within the region. In one embodiment, the field controlling means is an inner conductor shaped as a hollow member having a slot formed therein to form a helical arrangement, the electric field having both an axial and an azimuthal component.

As discussed in the General Operational Description:

Electrodeless lamps have the potential for extremely long life, because there is no need for the arc discharge to be in contact with any material, either electrodes (i.e., since there are none) or the lamp envelope. However, there is a tendency in the operation of high pressure electrodeless lamps in termination fixtures for the arc to be in close contact with the envelope walls, thereby causing damage to the wall and foreshortening the lamp's lifetime. Typically, this attachment of the arc to the wall of the lamp occurs at the point where the lamp is in contact with the center conductor of the fixture, where the electric field intensity is high.

The purpose of this invention is to provide an electrodeless arc discharge in which the arc is sufficiently isolated from the wall of the lamp envelope so that no damage to the wall occurs over a long period of time. An arc may be isolated from a particular area by adjusting the detailed power balance for that area. This involves the equation $P_e - P_h = P_r$, where $P_e$ is the power gained electrically, $P_r$ is the power radiated and $P_h$ is the power lost as heat.

Generally, an arc exists in a region where $P_e > P_h$. This invention relates to a way in which $P_e$ can be made small enough in a region so as not to allow an arc to exist there. $P_e = n_e \mu E^2$, where $n_e$ is the electron density, $\mu$ the electron mobility and E the electric field strength.

In a fixture such as the termination fixture described herein, it is possible to adjust the field strength E by one of several techniques. These techniques included adjusting the position of fixture conductors, shaping the center conductor or field coupling probe, adjusting the position and shape of lossless magnetic or dielectric material within the fixture, adjusting the shape of the exterior walls of the fixture, adjusting the configuration, position and material of the lamp envelope, and controlling the current paths on the exterior fixture walls by use of a pattern of conductors. Therefore, by using one or several of these techniques, one may reduce the field strength near the lamp wall, and thus the arc can be isolated from the walls. With arc isolation from the envelope wall, the lifetime is increased several orders of magnitude.

The presently preferred way of arc shaping is by appropriately shaping the geometry of the end of the inner conductor. In one preferred embodiment, the inner conductor of the termination fixture is shaped in the form of a helix. A helical center conductor allows use of a shorter termination fixture than a quarter wavelength; it allows for control over the field shape so that, the arc can be isolated from the envelope and, finally, it provides a means for impedance matching the lamp to the input.

Wave propagation on a helix is, in general, complex. However, much of the observed behavior of arcs in helices can be understood in terms of the dominant mode. This mode has a field pattern with an electric field component $E_z$ in axial direction, and also a field $E_\Phi$ in the azimuthal direction. Thus, in FIG. 2 a lamp placed in the region I ($R_I$) inside the helix might have either an axial arc or a toroidal (donut shaped) arc lying the horizontal plane. The ratio of the fields in (sic) controlled by the helix parameters; $E_z/E_\Phi=(a/r)\cot\Psi$. A lamp placed just above the helix in region II ($R_{II}$) would be excited in the axial direction.

As set forth in the Description of the Preferred Embodiments, preferably, the pitch of the slot 42 is variable to create a strong axial field in a region within the inner conductor and to compensate for at least a part of the reactive impedance of the lamp during excitation.

Axial arcs, toroidal arcs, and discharges apparently excited by both axial and azimuthal fields are obtainable. In particular, a lamp filled with mercury, sodium iodide, scandium iodide and argon having a cylindrical envelope was run axially; the arc was observed to isolate from both ends of the envelope when the lamp was appropriately placed just inside the helix in region $R_I$. Small mercury lamps in both cylindrical and spherical envelopes, have been run with isolated toroidal discharges, excited by the azimuthal field inside the helix. Finally, a metal halide lamp in a spherical envelope run inside the helix was apparently coupled to both components of the dominant helical mode. The discharge is quite diffuse and detached from the lamp wall.

U.S. Pat. No. 3,943,404

U.S. Pat. No. 3,943,404 suggests the use of a helix as a means for matching the complex impedance of the electrodeless lamp to the impedance of the source. As stated in the Abstract, a helical coil couples the end of the inner conductor to the electrodeless lamp. The purpose of the coil is to make the impedance of the lamp, as viewed, electrically, from the end of the inner conductor appear as having only the real component. The quarter wave fixture then matches the real impedance to the source impedance.

As set forth in the Summary of the Invention:

The light source includes a termination fixture which is coupled to a source of high frequency power. The fixture has an inner conductor and an outer conductor disposed around the inner conductor. These conductors have lengths of a quarter wavelength and cross-sectional dimensions selected to produce a fixture characteristic impedance which matches the real component of the complex impedance of an electrodeless lamp, which forms a termination to the conductors, to the impedance of the coupled source. The fixture includes a reactive impedance device which is coupled between the outer end of the inner conductor and the lamp. This device compensates for the reactive component of the complex impedance of the termination when the lamp is in the excited state. Usually, the reactive component of the lamp impedance is capacitive so that the compensating device is an inductance in series between the inner conductor and the lamp. Preferably, the inductance is a helical coil.

In the present invention, it is possible to obtain a perfect impedance match, despite the load impedance being complex. The compensating coil reduces fixture losses since the largest standing waves are confined to the lamp-coupler region. Also, the coil is a high thermal resistance element by virtue of its length and cross-section, thus reducing heat conduction losses from the lamp.

And in the Description of Preferred Embodiments (columns 4–5):

Since the dominant reactive impedance of the lamp is usually capacitive, the device 40 preferably is inductive. The inductive device 40, as illustrated in FIG. 5, is preferably a helical coil having a first end 42 in contact with the end of the inner conductor 20 and a second end 44 in contact with the lamp 14. In FIG. 5, coil 40 is formed with a bend 46 such that the first end 42 may be positioned in a receiving opening 48 formed in the end of the inner conductor 20. This provides a useful technique for holding the coil in a stationery (sic) position with respect to the inner conductor. The second end of the coil may be formed with a spherically shaped element to avoid high field breakdown.

The helical coil overcomes the imperfect coupling by providing a compensating series inductance. This is done by the use of a short helical extension to the center conductor of the termination fixture.

That is, the capacitance of the lamp is exactly compensated by the coil inductance, and the high frequency source impedance may be matched to this termination by the use of a quarter wave termination fixture. There are several advantages to this scheme of coupling. First, this embodiment makes it possible to run lamps with complex impedances quite efficiently. The coil reduces fixture losses since the largest standing waves are confined to the lamp coupler region and it provides a high thermal resistance element by virtue of its length and cross-section, thus reducing heat conduction losses from the lamp.

The primary purpose of the coil at the lamp is to provide some impedance matching for the lamp in the excited state.

In both the foregoing U.S. Patents, the electrodeless lamp lays mostly outside of the helix.

Other Patents

The following U.S. Patents may be of interest. At least one of the patentees of each patent is an applicant of this application. All patents have been assigned to a common assignee.

| U.S. Pat. No. | Patentee | Issue Date |
|---|---|---|
| 3,943,401 | Haugsjaa et al. | March 9, 1976 |
| 3,943,402 | Haugsjaa et al. | March 9, 1976 |

-continued

| U.S. Pat. No. | Patentee | Issue Date |
|---|---|---|
| 3,943,403 | Haugsjaa et al. | March 9, 1976 |
| 3,993,927 | Haugsjaa et al. | November 23, 1976 |
| 3,995,195 | Haugsjaa et al. | November 30, 1976 |
| 3,997,816 | Haugsjaa et al. | December 14, 1976 |
| 4,001,631 | McNeill et al. | January 4, 1977 |
| 4,001,632 | Haugsjaa et al. | January 4, 1977 |
| 4,002,943 | Regan et al. | January 11, 1977 |
| 4,002,944 | McNeill et al. | January 11, 1977 |
| 4,041,352 | McNeill et al. | August 9, 1977 |
| 4,053,814 | Regan et al. | October 11, 1977 |
| 4,065,701 | Haugsjaa et al. | December 27, 1977 |
| 4,070,603 | Regan et al. | January 24, 1978 |

Also of interest is the following U.S. Patent which relates to electrodeless lamps.

| | | |
|---|---|---|
| 3,787,705 | Bolin et al. | January 22, 1974 |

Prior Art Statement

The U.S. patents set forth hereinabove constitute prior art which includes, in the opinion of the applicants and their attorney, the closest prior art of which they are aware. This prior art statement shall not be construed as a representation that a search has been made or that no better art exists.

SUMMARY OF THE INVENTION

Another object of this invention is to provide for new and improved electrodeless lamp systems which utilize standing wave principles for achieving arc isolation.

Yet another object of this invention is to provide for new and improved electrodeless lamp systems which are more effective and more efficient at high power levels than corresponding systems of the prior art.

Still another object of this invention is to provide for new and improved electrodeless lamp systems which can operate at high power and long life.

Still yet another object of this invention is to provide for new and improved electrodeless lamp systems which have lifetimes in excess of 5000 hours without degradation.

In accordance with preferred embodiments of this invention, an electromagnetic discharge apparatus includes an electrodeless lamp having a generally cylindrically shaped envelope made of a light transmitting substance. A volatile fill material, enclosed within envelope, emits light upon breakdown and excitation. A termination fixture has an outer conductor disposed around its inner conductor, both conductors having a first end which couples power to the lamp and a second end coupled to an alternating current power source. The power source operates at a frequency which has a wavelength $\lambda$ (proportional to the free space wavelength $\lambda_o$). A first end of conductive means is coupled to the first end of the inner conductor, a second end of the conductive means being open-circuited. The conductive means has the same electrical length $\lambda$ whereby a voltage standing wave is presented thereon with voltage maxima occurring at the ends and center thereof and axial electric field minima occurring at distances $\lambda/4$ from each of its two ends. The envelope is oriented centrally and axially within the conductive means so that an axial, non-toroidal arc occurs within the envelope but does not attach to its interior walls, thereby enhancing the life of the lamp. The conductive means can be formed in a helical or spiral configuration. The spiral configuration can take various forms, such as constant or continuously varying. A small spherical conductor can be affixed to the second end of a helical conductive means to inhibit electrical breakdown from an otherwise sharp end. Preferably, the internal length of the envelope is such that substantially minimum electric field occurs at the ends thereof to inhibit attachment of an arc to the internal end walls thereof.

In one embodiment with a power source operating at a frequency having a wavelength $\lambda_o$, the electrical axial length of the spiral conductive means, when coiled, is wavelength $\lambda_z$. Thus, with an envelope (having an internal length substantially one-half of the wavelength $\lambda_z$) centrally and axially located within the spiral conductive means, a voltage standing wave is presented therealong with axial electric field maxima occurring $\lambda_z/4$ and $3\lambda_z/4$ back from the open-circuited end, and axial electric field minima occurring $\lambda_z/2$ and $\lambda_z$ from the open-circuited end of the spiral conductive means. An axial, non-toroidal arc occurs within the envelope but does not attach to its interior wall. With the outer conductor circumferentially surrounding the spiral conductive means and the envelope therewithin to form a cylinder having a radius b, and the spiral conductive means includes a coil having a radius a, and a constant pitch p, then $$\frac{\lambda_z}{\lambda_o} = \left[1 + \frac{2\pi^2 a^2}{p^2} \cdot \frac{1-(a/b)^2}{\log b/a}\right]^{-\frac{1}{2}}$$

With certain designs, a plurality of arcs can occur within the envelope.

In accordance with another embodiment of the invention, electrodeless discharge apparatus incorporates a power source at a frequency f having a wavelength $\lambda$ which is proportional, to the free space wavelength $\lambda_o$. An electrodeless lamp has a generally cylindrically shaped envelope made of a light transmitting substance. A volatile fill material, enclosed within the envelope, emits light upon breakdown and excitation. A termination fixture has an outer conductor disposed around an inner conductor, both conductors having a first end which couples power to the lamp, and a second end which is coupled to the power source. Conductive means have a first end coupled to the first end of the inner conductor and have a second end open-circuited. The distance of the conductive means from the ends of the envelope are related to the wavelength $\lambda$ so that a voltage standing wave is presented on the conductive means with voltage maxima occurring at the second end of the conductive means (n is an integer). The ends of the envelope are placed in close proximity to regions of minimum axial electric field so that an axial, non-toroidal arc occurs within the envelope, but does not attach to the interior walls thereof, thereby enhancing the life of the electrodeless discharge apparatus.

An electrodeless discharge apparatus having a generally cylindrically shaped envelope with an internal length $n\lambda/2$ (wherein n is a positive integer) can be excited by providing an electric field consisting of a voltage standing wave with points of axial electric field minima separated from each other by a distance $\lambda/2$ and orienting the lamp with respect to the field so that the opposed ends of the lamp are aligned with different points of axial electric field minima so that an axial, non-toroidal arc occurs within the envelope but does not attach to its interior wall.

BRIEF DESCRIPTION OF THE DRAWINGS

Other objects, advantages and features of this invention, together with its construction and mode of operation, will become more apparent when read in conjunction with the accompanying drawing in which:

FIG. 1A is a partial sectional view of an electrodeless lamp together with a fixture having a spiral center conductor;

FIG. 1B is a diagram showing the axial electric field $E_z$ with respect to points along the axis of the spiral conductor;

FIGS. 2A, 3A, 4A and 5A are partial sectional views of electrodeless lamps and fixtures having a spiral center conductor in accordance with other embodiments of the invention;

FIGS. 2B, 3B, 4B and 5B are diagrams indicating the axial electric field $E_z$ with respect to the axis of the spiral center conductor of the embodiments depicted in FIGS. 2A, 3A, 4A and 5A, respectively.

DESCRIPTION OF PREFERRED EMBODIMENTS

Figure 4A:
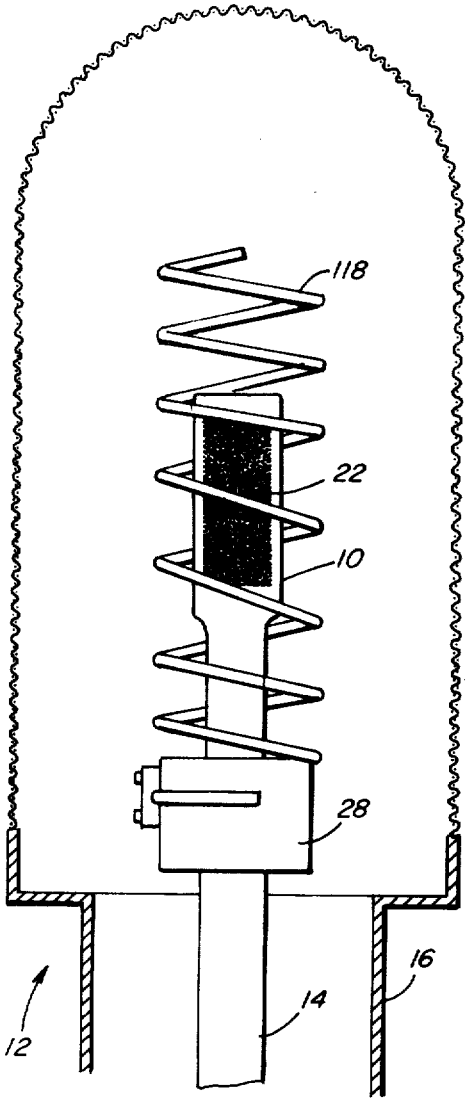

Electrodeless lamps have the potential for extremely long life because there is no need for the arc discharge to be in contact with any material, either electrodes (i.e., since there are none) or the lamp envelope. However, there is a tendency in the operation of high pressure electrodeless lamps in termination fixtures for the arc to be in close contact with the envelope walls, thereby causing damage to the wall and foreshortening the lamps lifetime. Typically, this attachment of the arc to the wall of the lamp occurs at the point where the lamp is in contact with the center conductor of the fixture where the electric field intensity is high. When the arc extends to the wall of the lamp, excess energy is conducted thereto and produces damage.

It is a purpose of this invention to provide an electrodeless arc discharge in which the arc is sufficiently isolated from the wall of the lamp envelope so that no damage to the wall occurs over a long period of time.

In an exemplary embodiment of this invention, as shown in FIG. 1A, a light source includes a source of power (not shown) at a high frequency, an electrodeless lamp 10, and a termination fixture 12 coupled to the source, such as by a coaxial cable including an inner conductor 14 and an outer conductor 16. As used herein, the phrase "high frequency" is intended to include frequencies in the range generally from 100 MHz to 300 GHz. Preferably, the frequency is in the ISM band (i.e., industrial, scientific and medical band) which ranges from 902 MHz to 928 MHz. A particularly preferred frequency is 915 MHz. One of the many commercially available power sources which may be used is an AIL Tech. Power Signal Source, type 125. The lamp has an envelope 10 made of a light transmitting substance, such as quartz. The envelope encloses a volatile fill material which produces a light emitting discharge upon excitation. Several known fill materials may be used which produce a high pressure discharge.

In FIG. 1A, a termination fixture 12 includes an inner conductor 14 and an outer conductor 16. As shown herein, the outer conductor 16 is disposed around the inner conductor 14. The conductors have active portions in the immediate vicinity of the electrodeless lamp 10 which are adapted to couple power to the lamp to produce excitation, and opposite ends adapted to be coupled to the source. The fixture 12 includes, as an arc shaping means, a coil 18 which is directly affixed to the inner conductor 14. The coil 18 produces an electric field in the region of the lamp in an axial direction with respect to the inner conductor 14, or with respect to the axis of the spiral coil 18. As depicted in FIG. 1A, the coil forms a spiral.

For the purpose of this specification, the term "spiral" is defined as: the three-dimensional locus of a point moving parallel to and about a central axis at a constant or varying distance.

Hence, "spiral" can take various forms. There can be a constant spiral; there can be a varying spiral; there can be a continuously varying spiral; and there can be intermittently varying spirals which are interlineated with constant spiral configurations.

Referring again to FIG. 1A, the cylindrical center conductor 14 of the termination fixture 12 is connected to the spiral coil 18 which consists of several turns of heat resistant conductive wire of small diameter. The coil 18 is open to permit the insertion of the electrodeless lamp 10 therewithin. The electrodeless lamp 10 typically has a cylindrical shape. The unattached end of the coil 18 terminates in a small sphere 20 used to prevent breakdown from any sharp end. Current flows in the cylindrical center conductor 14 when microwave power is applied to the termination fixture 12. The current continues into the helix, travelling along the wire 18 making up the spiral. It propagates as a wave having a sinusoidal dependence along the wire 18. The absolute value of the voltage standing wave is indicated in FIG. 1B. At the far end of the wire, away from the termination fixture, the wave reflects from the open end and tends to propagate back down the wire 18 along central conductor 14. In this way, the forward travelling wave and the reflected backward travelling wave sets up a standing wave on the spiral conductor 18 with a current maximum $\lambda/4$ from the open end and another current maximum $\lambda/2$ back toward the termination input. While the distance between these two maxima is $\lambda/2$ along the wire 18 it is greatly reduced along the axis. There is a strong axial electric field $E_z$ (as shown in FIG. 1B) which has maxima at the current maxima and dependence as shown in FIG. 1B. When the coil 18 has a radius a and a pitch p, the ratio of axial wavelength to the electrical wavelength along the wire is:

$$\lambda_z/\lambda_o \cong p/2\pi a$$

More precisely, the relation of $\lambda_z$ to $\lambda_o$ is as follows:

$$\frac{\lambda_z}{\lambda_o} = \left[1 + \frac{2\pi^2 a^2}{p^2} \cdot \frac{1-(a/b)^2}{\log b/a}\right]^{-\frac{1}{2}}$$

where $2b$ is the termination fixture outer diameter. The above two equations yield approximate results. From the first equation, it can be seen that for a coil of small pitch and large radius, the axial wavelength is much smaller than the free space wavelength.

It is desired to have a lamp operating with minimum electric fields at its ends. In such a case, the arc does not receive much power at the ends and will tend to detach as discussed in the Haugsjaa et al. patent, U.S. Pat. No. 3,942,068 discussed hereinabove. The electrodeless lamp is placed in the coil with its ends at field minima. A coil diameter and pitch can be chosen to accommodate a wide variety of lamp shapes and sizes. Impedance matching can be accomplished by adjusting the length of that portion of the coil outside the lamp, as described in U.S. Pat. No. 3,942,068 discussed above. Furthermore, the cylindrical center conductor can be modified for impedance matching. Also, a parallel capacitor could be used for impedance matching.

As depicted in FIG. 1A, the electrodeless lamp, when excited, forms an axial non-toroidal arc 22 between the points of axial electric field minima as indicated at FIG. 1B.

FIG. 2A indicates another embodiment which operates in conjunction with a voltage diagram shown in FIG. 2B. The reference numerals indicated in FIG. 2A correspond in similar fashion to those indicated in FIG. 1A. However, in the embodiment shown in FIG. 2A, two arcs 122 and 222 are shown. The two arcs occur substantially from points of axial electric field minima as indicated in FIG. 2B.

Another embodiment is depicted in FIGS. 3A and 3B in similar fashion. In the embodiment depicted in FIG. 3A, where again, like corresponding reference numerals indicate corresponding parts, there is depicted four arcs 122, 222, 322, and 422; each runs generally from points of axial electric field minima to its adjacent point of axial electric field minima. However, as depicted in FIG. 3A, it is possible for an arc 222 to join an adjacent arc 322 at a point 24. Such flow of one arc into another is not undesirable since the main requirement that the arcs not touch the walls or the ends of the electrodeless lamp have still been met.

As depicted in the drawings, the embodiments of FIGS. 1A, 2A and 3A depict constant spirals 18. However, as stated hereinabove, this invention is not limited to devices having constant spirals, but may include devices having variable spirals.

Figure 4B:
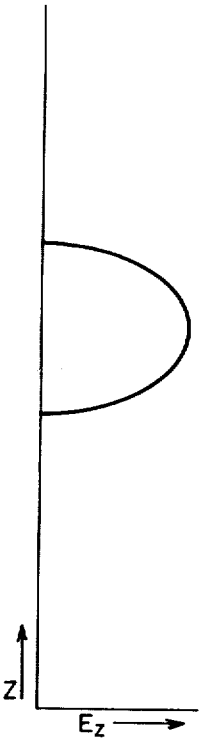

As depicted in FIGS. 4A and 4B, there is shown another embodiment of the invention, wherein like reference numerals indicate like parts, utilizing a variable spiral 118 conductor connected to the central conductor 14 of the termination fixture 12. The electrodeless lamp 10, in the embodiment depicted in FIG. 4A, is held in a fixture 28 which provides mechanical support for the electrodeless lamp 10 but does not act as a conductor or electrode therefor. The fixture 28 is also a medium by which the varying spiral coil 118 is affixed to the center conductor 14.

Figure 5A:
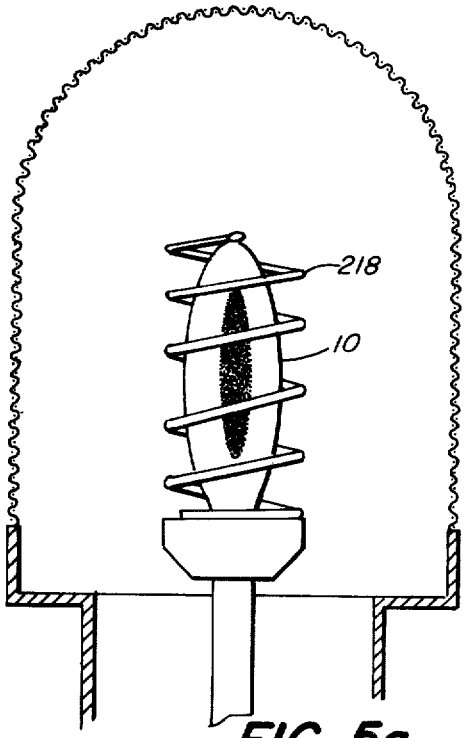
Figure 5B:
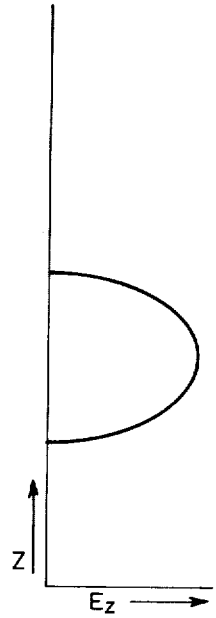

Another embodiment is depicted in FIGS. 5A and 5B, wherein a varying spiral coil 218 is utilized to actuate the electrodeless lamp 10.

Figure 6:
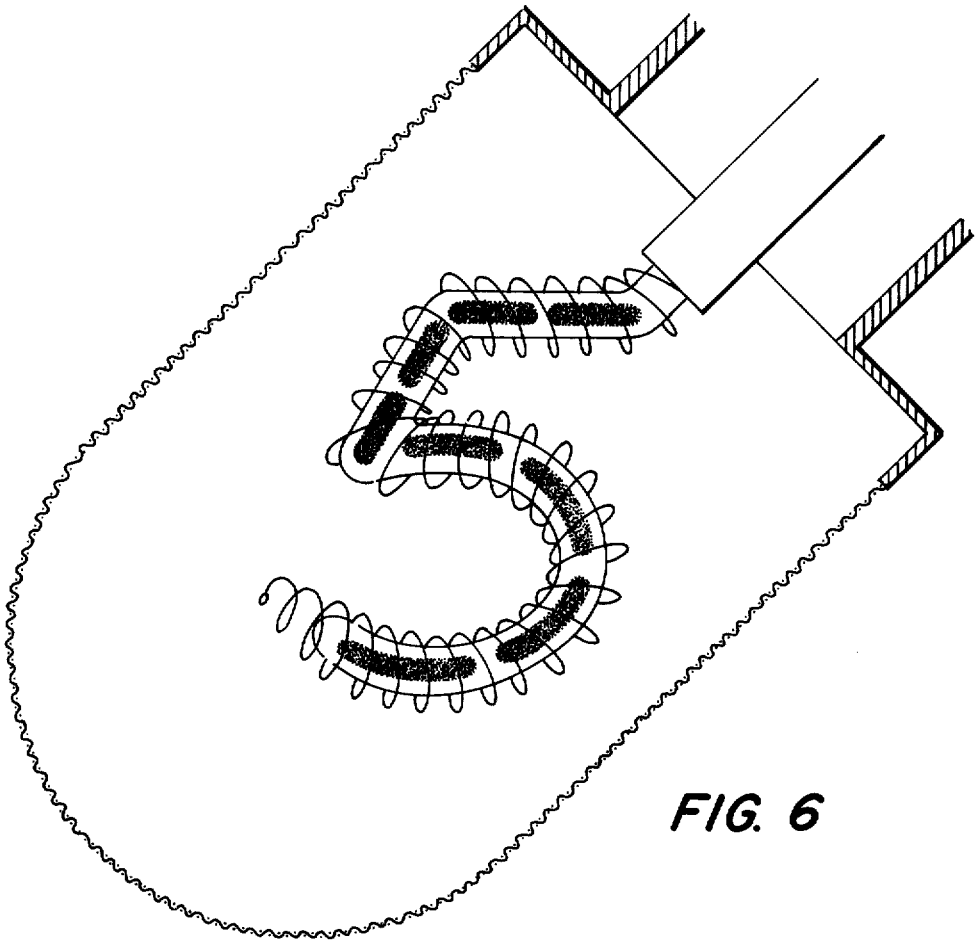
FIG. 6 is a partial sectional view of still yet another embodiment of the invention.

FIG. 6 discloses a system whereby an electrodeless lamp can be formed in an alpha-numeric configuration and excited by using a spiral configuration such that the electrodeless lamp is excited with a plurality of arcs of indicate alphanumeric information.

As examples, the electrodeless lamp depicted in FIG. 4A is a cylindrical studio type lamp with $HoI_3$/Hg/CsI/Ar fill. The spiral coil 118 is formed of tungsten wire. 400 watts of power were provided to the lamp with a lumen output of 42.1 kl. The diameter of the electrodeless lamp was 10 millimeters, and the length of the axial arc was 30 millimeters. The thickness of the lamp wall was 3 millimeters. The lamp fill included the following:

| | | |
|---|---|---|
| Hg | 7 mg/cc | 1.2 ul |
| $HoI_3$ | 2 mg/cc | 4.50 mg |
| CsI | 1 mg/cc | 2.35 mg |
| Ar | 10 Torr | |

FIG. 5A depicts "football" shaped or prolate spheroid lamp with a $ScI_3$/NaI/Hg/Ar fill. The coil 218 was formed of a 0.060 inch nickel tubing. The power to the lamp was 200 watts with a lumen output at 15.0 kl. The lamp diameter at its largest point was 18.3 millimeters with a 1 millimeter wall thickness (the lamp being formed of quartz), and a length from tip-to-tip of 40 millimeters. The lamp fill was:

| | |
|---|---|
| Hg | 1.1 μl |
| NaI | 0.36 mg |
| $ScI_3$ | 1.20 mg |
| Ar | 20 Torr |

Other embodiments and variations will suggest themselves to those skilled in the art, and it is intended that this invention be limited solely by the scope of the allowed claims.

What is claimed is:

1. An electromagnetic discharge apparatus comprising (a) a source of power at a high frequency f, having a wavelength λ which is proportional to the free space wavelength $\lambda_o$;

(b) an electrodeless lamp having a generally cylindrical shaped envelope made of a light transmitting substance and a volatile fill material enclosed within the envelope, the fill material emitting light upon breakdown and excitation, said envelope having an internal length substantially one-half of said wavelength λ;

(c) a termination fixture having an inner conductor and an outer conductor disposed around the inner conductor, the conductors having a first end which couples power to the lamp and a second end which is coupled to the power source; and (d) conductive means having a first end thereof coupled to the first end of said inner conductor, and having a second end thereof open-circuited; the electrical length of said conductive means being said wavelength λ so that a voltage standing wave is presented on said conductive means with voltage maxima occurring at the ends and center of said conductive means, and axial electric field minima occurring at distances λ/4 from each of the two ends of said conductive means; said envelope being oriented centrally and axially within said conductive means so that an axial, non-toroidal arc occurs within said envelope which does not attach to the interior walls of said envelope thereby enhancing the life of the electrodeless lamp.

2. The apparatus as recited in claim 1 wherein said conductive means is a helical conductive means.

3. The apparatus as recited in claim 2 further comprising a small spherical conductor affixed to said second end of said helical conductive means to inhibit electrical breakdown from an otherwise sharp end.

4. The apparatus as recited in claim 1 wherein said conductive means is spiral conductive means.

5. The apparatus as recited in claim 4 wherein said spiral conductive means is constant spiral conductive means.

6. The apparatus as recited in claim 4 wherein said spiral conductive means is continuously varying spiral conductive means.

7. The apparatus as recited in claim 1 wherein the internal length of said envelope is such that substantially minimum electric field occurs at the ends thereof to inhibit attachment of an arc to the internal end walls thereof.

8. An electromagnetic discharge apparatus comprising (a) a source of power at a high frequency f, having a wavelength, $\lambda_o$;

(b) an electrodeless lamp having a generally cylindrically shaped envelope made of a light transmitting substance and a volatile fill material enclosed within the envelope, the fill material emitting light upon breakdown and excitation, said envelope having an internal length substantially one-half of a wavelength $\lambda_z$;

(c) a termination fixture having an inner conductor and an outer conductor disposed around the inner conductor, the conductors having a first end which couples power to the lamp and a second end which is coupled to the power source; and (d) spiral conductive means having a first end thereof coupled to the first end of said inner conductor, and having a second end thereof open circuited; the electrical axial length of said spiral conductive means when coiled being said wavelength $\lambda_z$ so that a voltage standing wave is presented along said spiral conductive means with axial electric field maxima occurring $\lambda_z/4$ and $3\lambda_z/4$ back from the open circuited end and axial electric field minima occurring $\frac{1}{2}\lambda_z$ and $\lambda_z$ from the open circuited end of said spiral conductive means; said envelope being oriented centrally and axially within said spiral conductive means so that an axial, non-toroidal arc occurs within said envelope which does not attach to the interior walls of said envelope thereby enhancing the life of the electrodeless lamp.

9. The apparatus as recited in claim 8 wherein said outer conductor circumferentially surrounds said spiral conductive means and said envelope therewithin to form a cylinder thereabout having a radius b; and said spiral conductive means includes a coil having a radius a and a constant pitch p.

10. The apparatus as recited in claim 9 wherein:

$$\frac{\lambda_z}{\lambda_o} = \left[1 + \frac{2\pi^2 a^2}{p^2} \cdot \frac{1 - (a/b)^2}{\log b/a}\right]^{-\frac{1}{2}}$$

11. An electromagnetic discharge apparatus comprising (a) a source of power at a high frequency f, having a wavelength $\lambda_o$;

(b) an electrodeless lamp having a generally cylindrically shaped envelope made of a light transmitting substance and a volatile fill material enclosed within the envelope, the fill material emitting light upon breakdown and excitation, said envelope having an internal length substantially n halves of a wavelength $\lambda_z$;

(c) a termination fixture having an inner conductor and an outer conductor disposed around the inner conductor, the conductors having a first end which couples power to the lamp and a second end which is coupled to the power source; and (d) spiral conductive means having a first end thereof coupled to the first end of said inner conductor, and a second end thereof open-circuited; the electrical length of said spiral conductive means when uncoiled being $(1+n)$ halves of said wavelength $\lambda_o$ and the electrical axial length of said spiral conductive means when coiled being $(1+n)$ halves of said wavelength $\lambda_z$ so that a voltage standing wave is presented along the axis of said spiral conductive means with axial electric field minima occurring at the ends of said conductive means and at n intervals displaced from one of said conductive means ends, and axial electric field maxima occurring at distances $\lambda_z/4$ from each of the two ends of said spiral conductive means plus $(n-1)$ additional axial electric field maxima occurring at distances integral multiples of $\lambda_z/2$ therefrom along the axis of and within said spiral conductive means;

said envelope being oriented centrally and axially within said spiral conductive means so that a series of n axial, non-toroidal arcs occur within said envelope which do not attach to the interior walls of said envelope thereby enhancing the life of the electrodeless lamp;

said outer conductors circumferentially surrounding said spiral conductive means and said envelope therewithin to form a cylinder thereabout having a radius b; and said spiral conductive means including a coil having a radius a and a pitch p.

12. The apparatus as recited in claim 11 wherein n is a positive integer.

13. The apparatus as recited in claim 12 wherein $$\frac{\lambda_z}{\lambda_o} = \left[1 + \frac{2\pi^2 a^2}{p^2} \cdot \frac{1 - (a/b)^2}{\log b/a}\right]^{-\frac{1}{2}}$$

14. Electrodeless discharge apparatus comprising (a) a source of power at a high frequency f, having a wavelength $\lambda$ which is proportional to the free space wavelength $\lambda_o$;

(b) an electrodeless lamp having a generally cylindrical shaped envelope made of a light transmitting substance and a volatile fill material enclosed within the envelope, the fill material emitting light upon breakdown and excitation;

(c) a termination fixture having an inner conductor and an outer conductor disposed around the inner conductor, the conductors having a first end which couples power to the lamp and a second end which is coupled to the power source; and (d) conductive means having a first end thereof coupled to the first end of said inner conductor, and having a second end thereof open-circuited; the distance of said conductive means from the ends of the said envelope being related to said wavelength $\lambda$, so that a voltage standing wave presented on said conductive means with voltage maxima occurring at said second end of said conductive means and at distances $n\lambda/2$ from said second end of said conductive means, where n is an integer, the ends of said envelope being placed in close proximity to regions of minimum axial electric field so that an axial, non-toroidal arc occurs within said envelope which does not attach to the interior walls of said envelope thereby enhancing the life of the electrodeless discharge apparatus.

15. The apparatus as recited in claim 14 wherein said conductive means is a helical conductive means.

16. The apparatus as recited in claim 15 further comprising a small spherical conductor affixed to said second end of said helical conductive means to inhibit electrical breakdown from an otherwise sharp end.

17. The apparatus as recited in claim 14 wherein said conductive means is spiral conductive means.

18. The apparatus as recited in claim 17 wherein said spiral conductive means is constant spiral conductive means.

19. The apparatus as recited in claim 17 wherein said spiral conductive means is continuously varying spiral conductive means.

20. The apparatus as recited in claim 14 wherein the internal length of said envelope is such that substantially minimum electric field occurs at the ends thereof to inhibit attachment of an arc to the internal end walls thereof.

21. Electrodeless discharge apparatus comprising (a) a source of power at a high frequency f, having a wavelength $\lambda_o$;

(b) an electrodeless discharge vessel having interior walls forming a generally cylindrically shaped envelope made of a light transmitting substance and a volatile fill material enclosed within the envelope, the fill material emitting light upon breakdown and excitation, said envelope having an internal length substantially n halves of an axial wavelength $\lambda_z$ being related to said wavelength $\lambda_o$ by a geometrical factor;

(c) a termination fixture having an inner conductor and an outer conductor disposed around the inner conductor, the conductors having a first end which couples power to the discharge inside said vessel and a second end which is coupled to said power source; and (d) spiral conductive means having a first end thereof coupled to the first end of said inner conductor, and a second end thereof open circuited, said envelope being placed within said spiral conductive means such that regions of axial electric field minima are in close proximity to ends of said envelope interior walls and said axial electric field minima occurring at said second end of said spiral conductive means and at distances of $n\lambda_z/2$ from said second end of said spiral conductive means;

said envelope being oriented centrally and axially within said spiral conductive means so that a series of n axial, non-toroidal arcs occur within said envelope which do not attach to the interior walls of said envelope, thereby enhancing the life of the electrodeless lamp, said outer conductor circumferentially surrounding said spiral conductive means and said envelope therewithin to form a cylinder thereabout having a radius b, and said spiral conductive means including a coil having a variable radius a and a variable pitch p, wherein n is an integer.

22. The apparatus as recited in claim 21 wherein n is a positive integer.

23. The apparatus as recited in claim 22 wherein $$\frac{\lambda_z}{\lambda_o} = \left[1 + \frac{2\pi^2 a^2}{p^2} \cdot \frac{1 - (a/b)^2}{\log b/a}\right]^{-\frac{1}{2}}$$

24. A method of exciting an electrodeless discharge apparatus having a generally cylindrical shaped envelope made of a light transmitting substance and a volatile fill material enclosed within the envelope, the fill material emitting light upon breakdown and excitation, said envelope having an internal length w comprising (a) a termination fixture having an inner conductor and an outer conductor disposed around the inner conductor, the conductors having a first end which couples power to the lamp and a second end which is adapted to be coupled to a power source;

(b) a helical conductive means having a first end thereof coupled to the first end of said inner conductor, and a second end thereof open circuited; the electrical length of said helical conductive means when uncoiled having a value x and the electrical axial length of said helical conductive means when coiled being a value y; said helical conductive means including a coil having a radius a and a pitch p; said outer conductor circumferentially surrounds said helical conductive means and said envelope therewithin to form a cylinder having a radius b; said envelope being oriented centrally and axially within said helical conductive means; and (c) a source of power at a high frequency f, having a wavelength $\lambda_o$ so that $$\lambda_o = x$$
$$\lambda_z = y;\ \lambda_z = 2w \text{ and}$$
$$\frac{\lambda_z}{\lambda_o} = \left[1 + \frac{2\pi^2 a^2}{p^2} \cdot \frac{1 - (a/b)^2}{\log b/a}\right]^{-\frac{1}{2}}$$

whereby a voltage standing wave is presented along the axis of said helical conductive means with axial electric field minima occurring at the end at $n\lambda_z/2$ back from the said first end of said conductive means, and axial electric field maxima occurring at a distance $\lambda_z(2n+1)/4$ from the said first end of said helical conductive means, so that an axial, non-toroidal arc occurs within said envelope which does not attach to the interior wall of said envelope thereby enhancing the life of the electrodeless lamp, wherein n is an integer.

25. A method of exciting an electrodeless discharge apparatus having a generally cylindrical shaped envelope made of a light transmitting substance and a volatile fill material enclosed within the envelope, the fill material emitting light upon breakdown and excitation, said envelope having an internal length $n\lambda/2$ with opposed ends, comprising (a) providing an electric field consisting of a voltage standing wave with points of axial electric field minima separated from each other by a distance $\lambda/2$; and (b) orienting said lamp with respect to said field so that said opposed ends are aligned with different points of axial electric field minima, whereby n is a positive integer, so that an axial, non-toroidal arc occurs within said envelope which does not attach to the interior wall of said envelope thereby enhancing the life of the electrodeless lamp.

* * * * *